US006267108B1

(12) United States Patent
McPherson et al.

(10) Patent No.: US 6,267,108 B1
(45) Date of Patent: Jul. 31, 2001

(54) SINGLE CAM CROSSBOW HAVING LEVEL NOCKING POINT TRAVEL

(75) Inventors: Mathew A. McPherson, 19055 Tocline Rd., Norwalk, WI (US) 54648; Gary L. Simonds, West Salem, WI (US)

(73) Assignee: Mathew A. McPherson, Norwalk, WI (US)

( * ) Notice: Subject to any disclaimer, the term of this patent is extended or adjusted under 35 U.S.C. 154(b) by 0 days.

(21) Appl. No.: 09/502,152

(22) Filed: Feb. 11, 2000

(51) Int. Cl.[7] ..... F41B 5/12
(52) U.S. Cl. ..... 124/25; 124/25.6
(58) Field of Search ..... 124/25, 25.6, 900

(56) References Cited

U.S. PATENT DOCUMENTS

| | | | |
|---|---|---|---|
| D. 331,614 | 12/1992 | Martin et al. | D22/107 |
| 3,841,295 | 10/1974 | Hunter . | |
| 3,854,467 | 12/1974 | Hofmeister . | |
| 3,958,551 | 5/1976 | Ketchum . | |
| 3,993,039 | 11/1976 | Groves et al. . | |
| 4,372,285 | 2/1983 | Simonds et al. | 124/90 |
| 4,401,097 | 8/1983 | Simonds et al. . | |
| 4,438,753 | 3/1984 | Simonds . | |
| 4,440,142 | 4/1984 | Simonds . | |
| 4,458,657 | 7/1984 | Stockmar | 124/17 |
| 4,461,267 | 7/1984 | Simonds et al. . | |
| 4,478,203 | 10/1984 | Hayes . | |
| 4,512,326 | 4/1985 | Jarrett . | |
| 4,649,891 | 3/1987 | Bozek | 124/25 |
| 4,660,536 | 4/1987 | McPherson . | |
| 4,693,228 | 9/1987 | Simonds et al. | 124/25 |
| 4,827,894 | 5/1989 | Schallberger | 124/25 |
| 4,838,236 | 6/1989 | Kudlacek . | |
| 4,909,231 | 3/1990 | Larson . | |
| 4,993,399 | 2/1991 | Chattin | 124/25.6 |
| 5,005,554 | 4/1991 | Shepley et al. | 124/24.1 |
| 5,025,771 | 6/1991 | Hanson | 124/25 |
| 5,040,520 | 8/1991 | Nurney | 124/25.6 |
| 5,174,268 | 12/1992 | Martin et al. | 124/25.6 |
| 5,307,787 | 5/1994 | LaBorde et al. | 124/25.6 |
| 5,368,006 | 11/1994 | McPherson | 124/25.6 |
| 5,495,843 | 3/1996 | Larson | 124/25.6 |
| 5,505,185 | 4/1996 | Miller | 124/25.6 |
| 5,515,836 | 5/1996 | Martin et al. | 124/23.1 |
| 5,638,804 | 6/1997 | Remick et al. | 124/25.6 |
| 5,649,520 | 7/1997 | Bednar | 124/25 |
| 5,678,529 | 10/1997 | Larson | 124/25.6 |
| 5,782,229 | 7/1998 | Evans et al. | 124/25.6 |
| 5,809,982 | 9/1998 | McPherson | 124/25.6 |
| 5,884,614 | 3/1999 | Darlington et al. | 124/25 |
| 5,934,265 | 8/1999 | Darlington | 124/25.6 |

OTHER PUBLICATIONS

Advertisement featured in Apr. 1998 and Jun. 1998 issues of "Bow Hunting World".
Bow & Arrow publication of Apr. 1980.
Bow & Arrow publication Dec. 1975.
Advertising from Allen, The Original Compound Bow, Dec. 1975.
Dynabo (Models M–10 Cheetah & Jim Cox Magnum) Instruction Manual Excerpt, mid–1970's.
KAM–ACT MK–2" Instruction Manual Excerpt, early–1970's.
KAM–ACT Instruction Manual Excerpt for Martin Archery, Inc., "New for "74Δ", mid–1970's.
Ben Pearson Archery advertisement.
Hoyt Archery advertisement.
Browning advertisement.

*Primary Examiner*—John A. Ricci
(74) *Attorney, Agent, or Firm*—Vidas, Arrett & Steinkraus

(57) ABSTRACT

A crossbow with level nocking point travel comprises an inventive cam assembly having a first groove defining a primary string payout track, a second groove defining a secondary string payout track and a third groove defining a take-up track. The ratio of the length of the take-up track to the length of the primary string payout track is less than about 0.4.

18 Claims, 10 Drawing Sheets

SINGLE CAM CROSSBOW HAVING LEVEL NOCKING POINT TRAVEL

FIELD OF THE INVENTION

This invention relates generally to crossbows. More specifically, the invention relates to crossbows having a single cam with straight line nocking point travel.

BACKGROUND OF THE INVENTION

Crossbows have an extensive history dating back many centuries to medieval times. Samples of crossbows and written descriptions of crossbows dating back to medieval times may be found in many museums throughout the world. The modem crossbows currently in use have evolved from the crossbows used centuries ago.

There are two well accepted methods for launching an arrow from a modern crossbow. One method employs a track type crossbow design. The other method employs a trackless design.

In the track type crossbow design, an arrow shaft rests in a track located in the stock of the crossbow in the full drawn cocked position. The arrow is launched from the crossbow by being pushed down the track with the bowstring and the arrow both maintaining intimate contact with the track until the arrow has cleared the bow. The arrows used in this type of crossbow are usually blunt at the rear end of the arrow. The bowstring that propels the arrow simply pushes against the blunt end to propel the arrow from the crossbow.

In the trackless type crossbow design, the arrow is supported on an arrow rest towards the front of the arrow shaft and the rear of the arrow is supported by being nocked to the bowstring in the same manner as is used in conventional bows.

Modern crossbows, whether of the track variety or of the trackless variety, differ from medieval crossbows in part in that they make use of twin cam leveraging units located on the tips of the bow limbs.

Twin cams have progressed from simple variable leveraging units consisting of circular shapes mounted eccentrically to more complex shapes that are intended to create more energy storage for a given power stroke. As the cam profiles have become more complex in order to store more energy, it has become more critical and more difficult to synchronize one cam to the other. It is well-documented that improper cam synchronization effects arrow flight characteristics and can result in radical deviations at the nock end of the arrow, deviations that can depart from the desired straight line impulse required for the best accuracy.

The nocking problem is similar to the well known 'Archers Paradox' in which the longitudinal axis of an arrow placed into the bow for launch is not in line with the plane of travel of the bow string. Thus, the arrow does not appear to be aimed in the direction of launch. When the arrow's longitudinal axis does not lay on or very close to the plane of bowstring travel it becomes necessary to carefully match the stiffness (or spine) of the arrow to the bow and the particular set-up that is being used.

The conventional crossbows of years past required that the limbs be carefully matched for spring rate so that each limb tip pulled with equal force on its end of the string. If one limb were slightly stiffer than the other, the bowstring would be pulled slightly in the direction of the stronger limb. By having the launch string push against a blunt end of the projectile, the forces that would be imparted laterally to the rear of the projectile were minimized to the point that they would not push the rear of the projectile laterally out of the track as the projectile was launched.

With the advent of compound crossbows, the same situation exists today. The problem is not so much due to a mismatch in limb spring rate as it is due to being able to accurately synchronize the rotation of the cams at each limb tip.

Much effort has been directed towards the goal of attaining better cam synchronization and solving the nocking problem. To that end, U.S. Pat. No. 4,440,142 discloses a tunable yoke system. Other patents directed toward achieving proper cam synchronization include U.S. Pat. No. 4,372,285, U.S. Pat. No. 4,909,231, U.S. Pat. No. 5,307,787, U.S. Pat. No. 5,505,185 and U.S. Pat. No. 5,515,836. In U.S. Pat. No. 5,505,185 to Miller, for example, the simple circular idler wheel of U.S. Pat No. 5,368,006 is replaced with a multi-track element capable of taking up bowstring on one side of the element at a different rate than it was paring out bowstring on the other side. Another method of cam synchronization is the Jennings micro tune system.

Many of the modem crossbow designs have adopted the compound bow technology using radically profiled cams to achieve greater energy storage. The greater peak draw weights that are attainable using crossbows as compared to conventional bows combined with the use of increased power strokes on today's crossbows as compared to older conventional crossbows, result in problems associated with non-linear loading at the nock end of the projectile which are greater than in the past. Yet, the problems have heretofore gone unrecognized.

The use of some of the newer radically profiled cams has resulted in discrepancies in cam timing. Discrepancy in cam timing on a compound crossbow will result in the cam with the most mechanical advantage at any given time pulling the attached bowstring in the direction of the advantaged cam. The bowstring in turn, will impart a horizontal force to the end of the arrow shaft at 90° to the direction of the intended arrow travel.

In the case of the track type crossbow, the nock end of the arrow rests against the bowstring with a force that is equal to the launch force being exerted on the shaft of the arrow. Therefore, the force that is exerted on the arrow due to any discrepancy in cam synchronization is equal to the propelling force multiplied by the coefficient of friction between the bowstring and the end of the nock. If the force generated in this matter is significant enough, it can cause the nock end of the arrow to be displaced as it is launched down the track.

The degree of cam non-synchronization in relation to the coefficient of friction between the nock end of the projectile and the bowstring must be significant on a track type crossbow to cause a noticeable problem in arrow flight. Normally, the side forces generated by the bowstring friction against the arrow nock are resisted by the side forces the track exerts against the arrow where it is being supported and satisfactory arrow flight can be achieved.

The trackless crossbow design is more susceptible to the effects of the cams not being properly synchronized because the arrow is only supported at its front and is intimately attached to the bowstring at the rear or nock end of the arrow. In many cases, arrows supported in this manner become free of the front support prior to the rear end of the arrow clearing the bow during launch. Unfortunately, the rear end of the arrow is free to be acted upon by the external forces exerted by the bowstring as soon as it clears the trigger assembly. As a result, any cam synchronization problem that causes the bowstring to be pulled in one direction or the other during the launch of the arrow will have a tendency to displace the nock end of the arrow horizontally in the same direction. This results a corresponding degree of erratic arrow flight.

Given the adverse effects on arrow flight that can result from a lack of synchronization between twin cams on a crossbow, it would be desirable to have a crossbow that does not require synchronization and reacts in a consistent fashion during arrow launch without imparting unwanted forces to the rear end of the arrow.

For the purpose of this disclosure, all US patents and patent applications and all other publications referenced herein are incorporated herein by reference in their entirety.

BRIEF SUMMARY OF THE INVENTION

The instant invention is directed to a means to achieve both level and straight line nocking point travel on a dual feed-out single take-up, single cam crossbow in its simplest form. A truly straight line as well as level nock travel is achieved on a crossbow having only one profiled cam element and one circular idler wheel element each attached to the opposite limb tips of the bow.

In one embodiment, the invention is directed to a crossbow comprising a limb mounting portion, a first limb supported by the mounting portion and a second limb supported by the mounting portion. A pulley is pivotally mounted upon the first limb for rotation about a first axle. The pulley includes a pulley track. A cam assembly is pivotally mounted upon the second limb for rotation about a second axle. The cam assembly has a primary string payout track along its periphery to accommodate a cable therein, a secondary string payout track to accommodate a cable therein and a take-up track to accommodate a cable therein. The ratio of the length of the take-up track to the length of the primary string payout track is less than about 0.4.

Desirably, the crossbow will further comprise a first cable and an anchor cable. The first cable has a first end portion terminating in a first end anchored to the cam assembly and a second end portion terminating in a second end anchored to the cam assembly. The first end portion is received in the primary string payout track and the second end portion is received in the secondary string payout track. A portion of the first cable is trained about the pulley and received in the pulley track to form a bow-string section and a return section. The anchor cable extends between the first limb and the cam assembly and is received in the take-up track.

In another embodiment, the invention is directed to a crossbow exhibiting a straight line nock travel when the bow is drawn and shot.

These and other more detailed and specific objectives and an understanding of the invention will become apparent from a consideration of the following Detailed Description of the Invention in view of the Drawings.

DETAILED DESCRIPTION OF THE INVENTION

Figure 1:
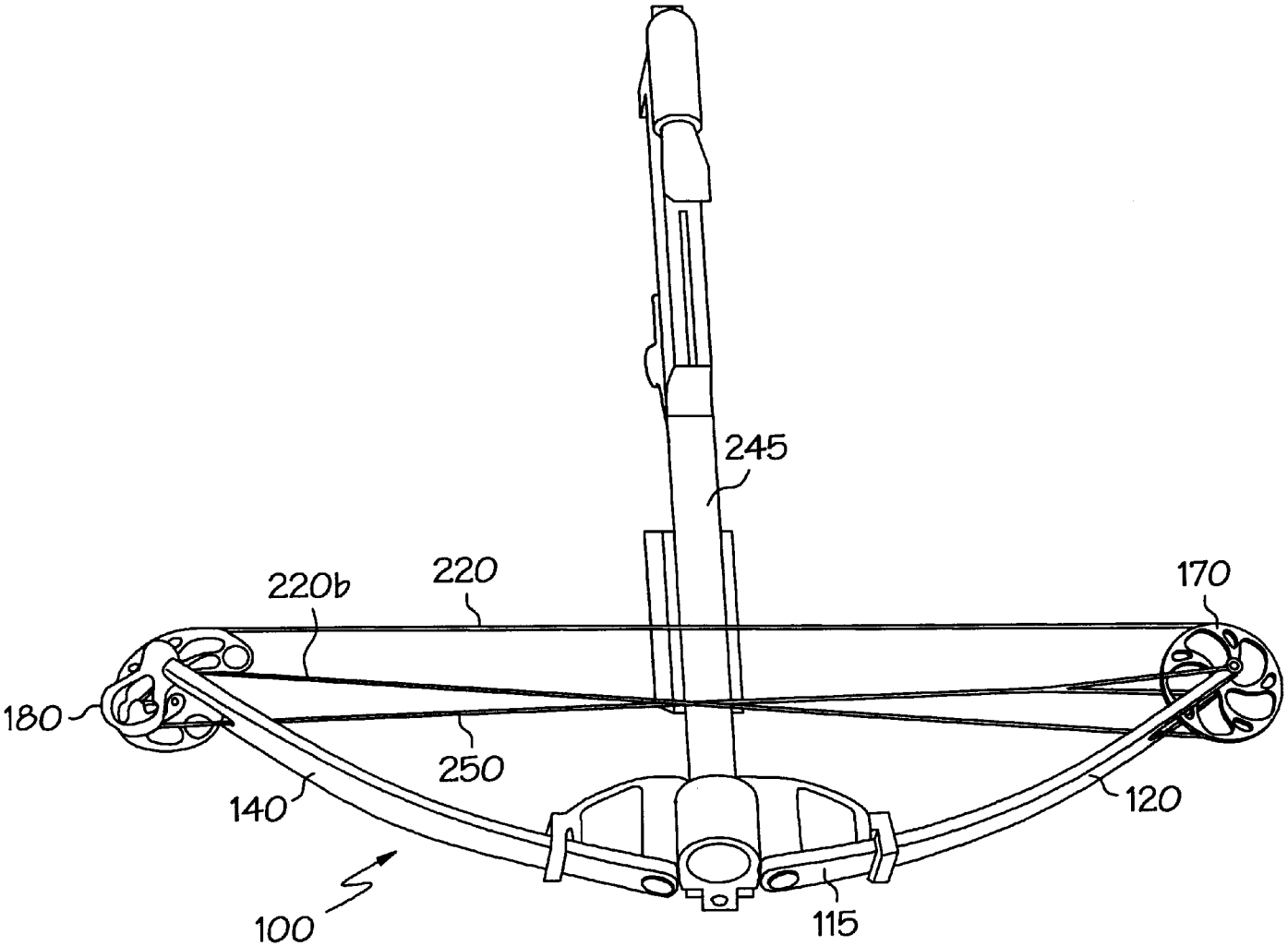
FIG. 1 shows an inventive crossbow.

While this invention may be embodied in many different forms, there are shown in the drawings and described in detail herein a specific preferred embodiment of the invention. The present disclosure is an exemplification of the principles of the invention and is not intended to limit the invention to the particular embodiment illustrated.

Figure 2:
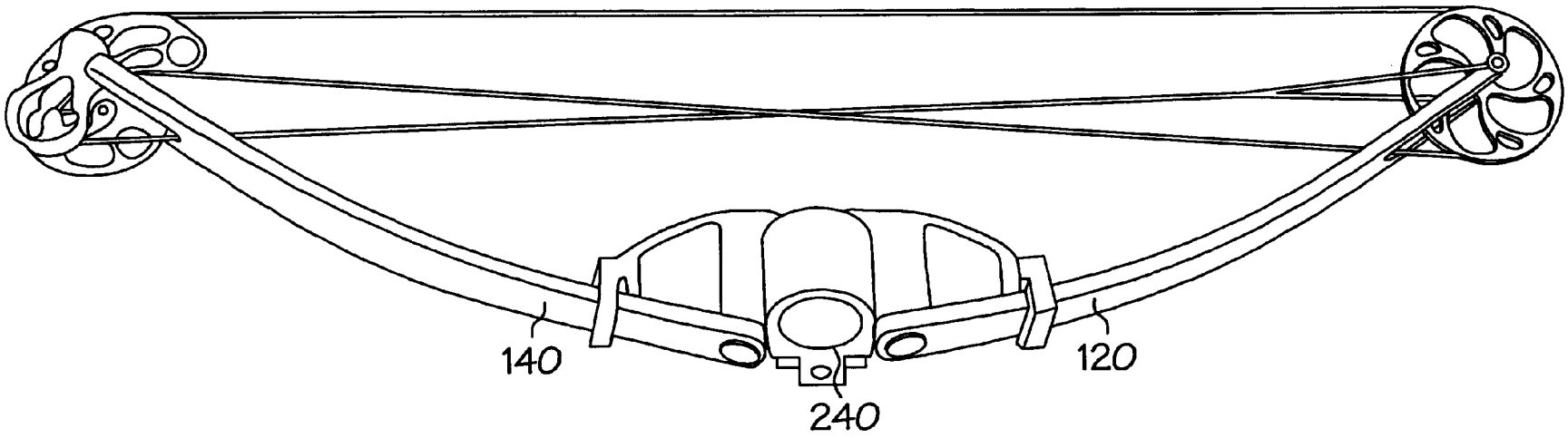
FIG. 2 shows the crossbow of FIG. 1 absent the stock.
Figure 3:
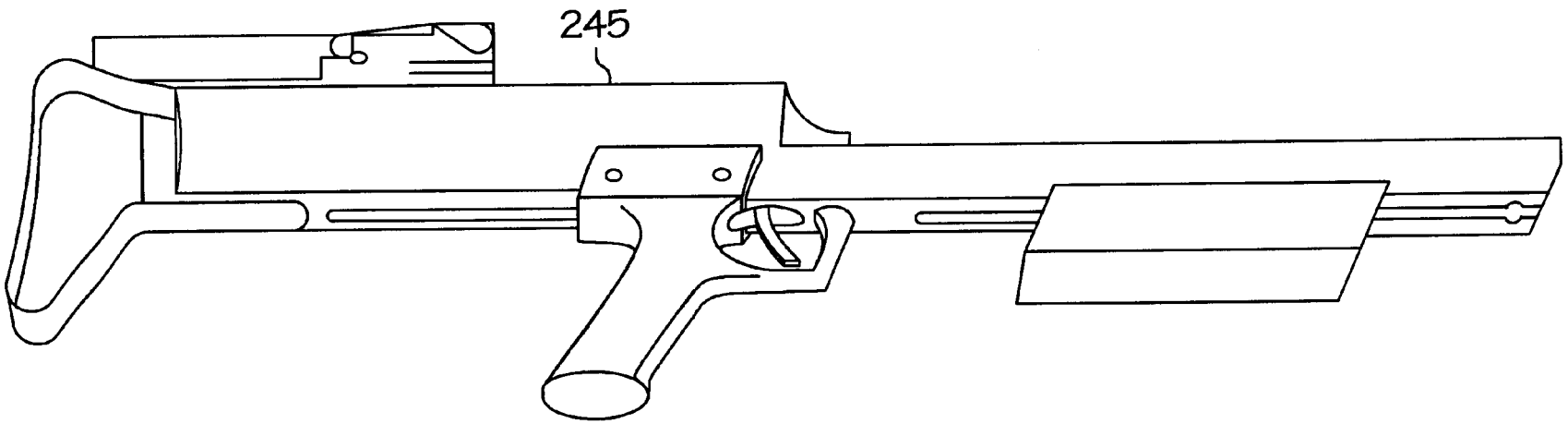
FIG. 3 shows the crossbow stock of FIG. 1.

The inventive crossbow, is shown generally at 100 in FIG. 1, in the undrawn state. Crossbow 100 includes a mounting portion 115 with an first flexible limb 120 and a second flexible limb 140 supported thereon. The first and second limbs 120 and 140 provide the desired resistance to bending which determines the draw weight of the bow and the force with which the arrow (not shown) is discharged. The first and second limbs may be made separately or may be made of one piece construction. As shown in FIG. 2, an opening 240 is present between first flexible limb 120 and second flexible limb 140 to receive one end of stock 245 therein. Stock 245, shown separately in FIG. 3, includes a trigger and bow string release member as known in the art. The stock and limbs may also be made of one piece construction.

Figure 5:
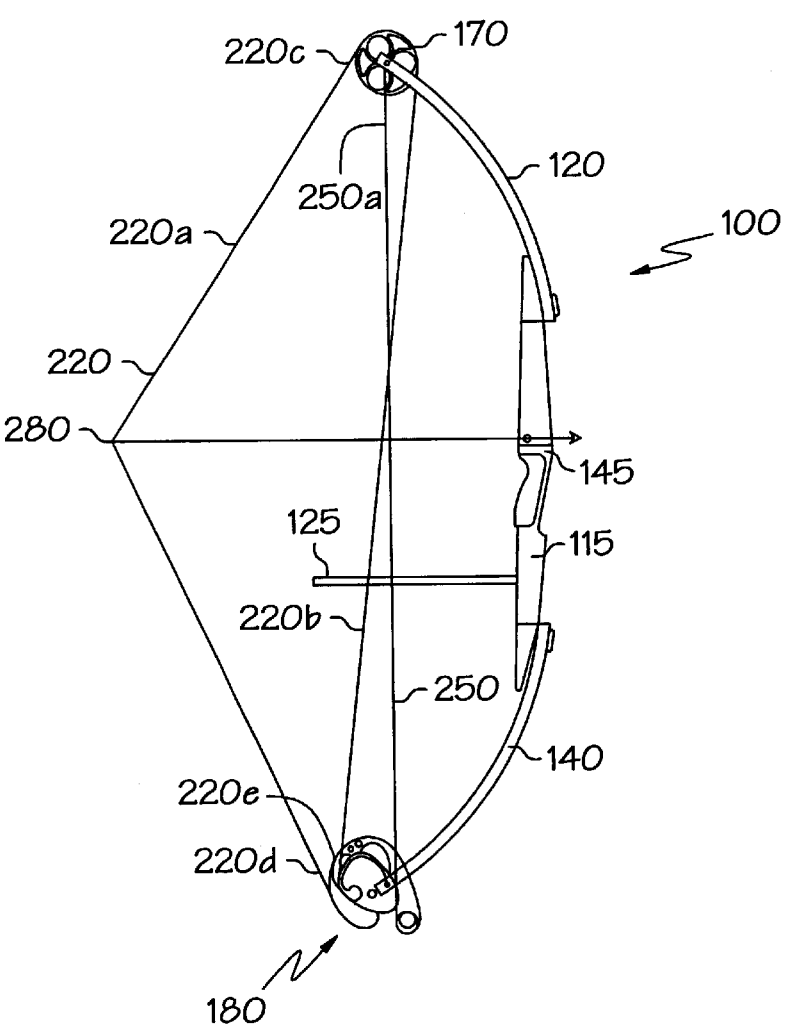
FIG. 5 is a side elevational view of the crossbow of FIG. 4 in the drawn state, absent the stock.
Figure 4:
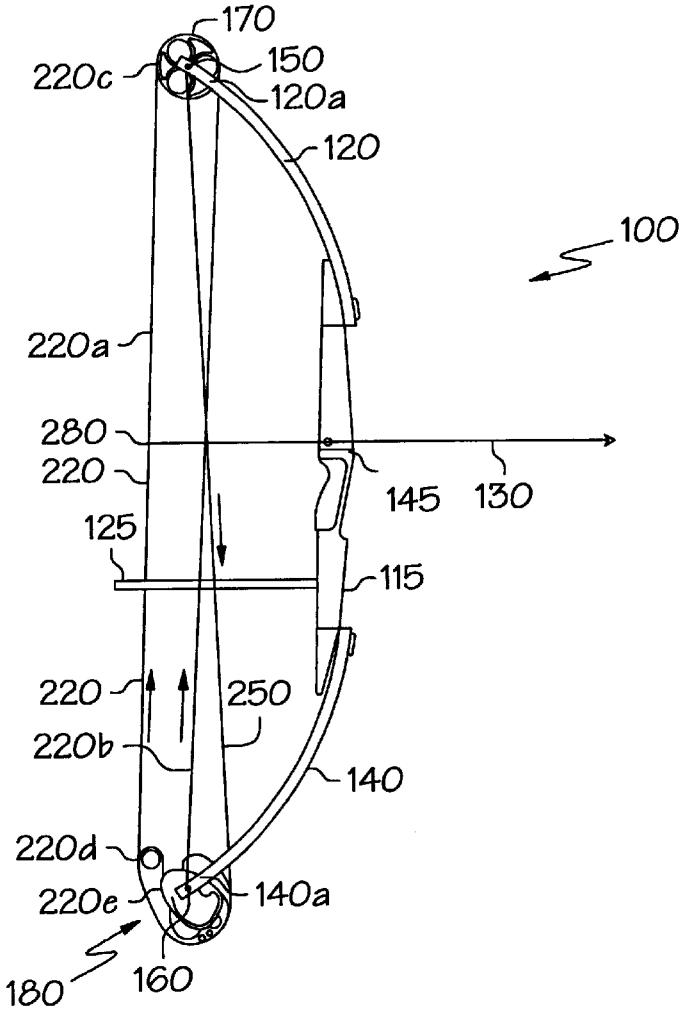
FIG. 4 is a side elevational view of an inventive crossbow in the undrawn state absent the stock.

For the sake of clarity, an embodiment of the inventive crossbow is shown, absent the stock, in FIG. 4 in the undrawn state and in FIG. 5 in the drawn state. Arrow 130 is shown resting in optional arrow rest 145.

Figure 6:
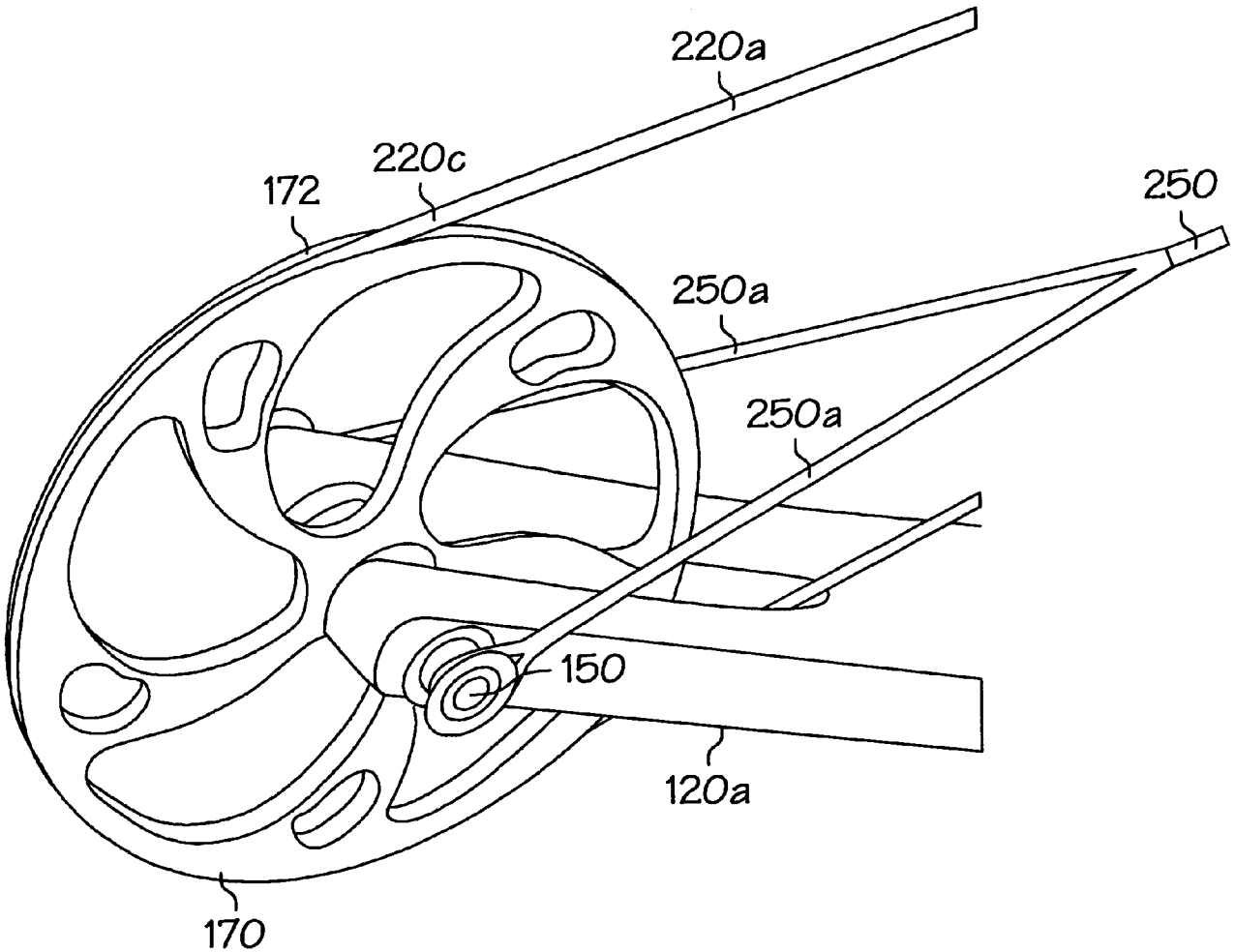
FIG. 6 is an enlarged view of the pulley of FIG. 1, as shown in an undrawn state.
Figure 7A:
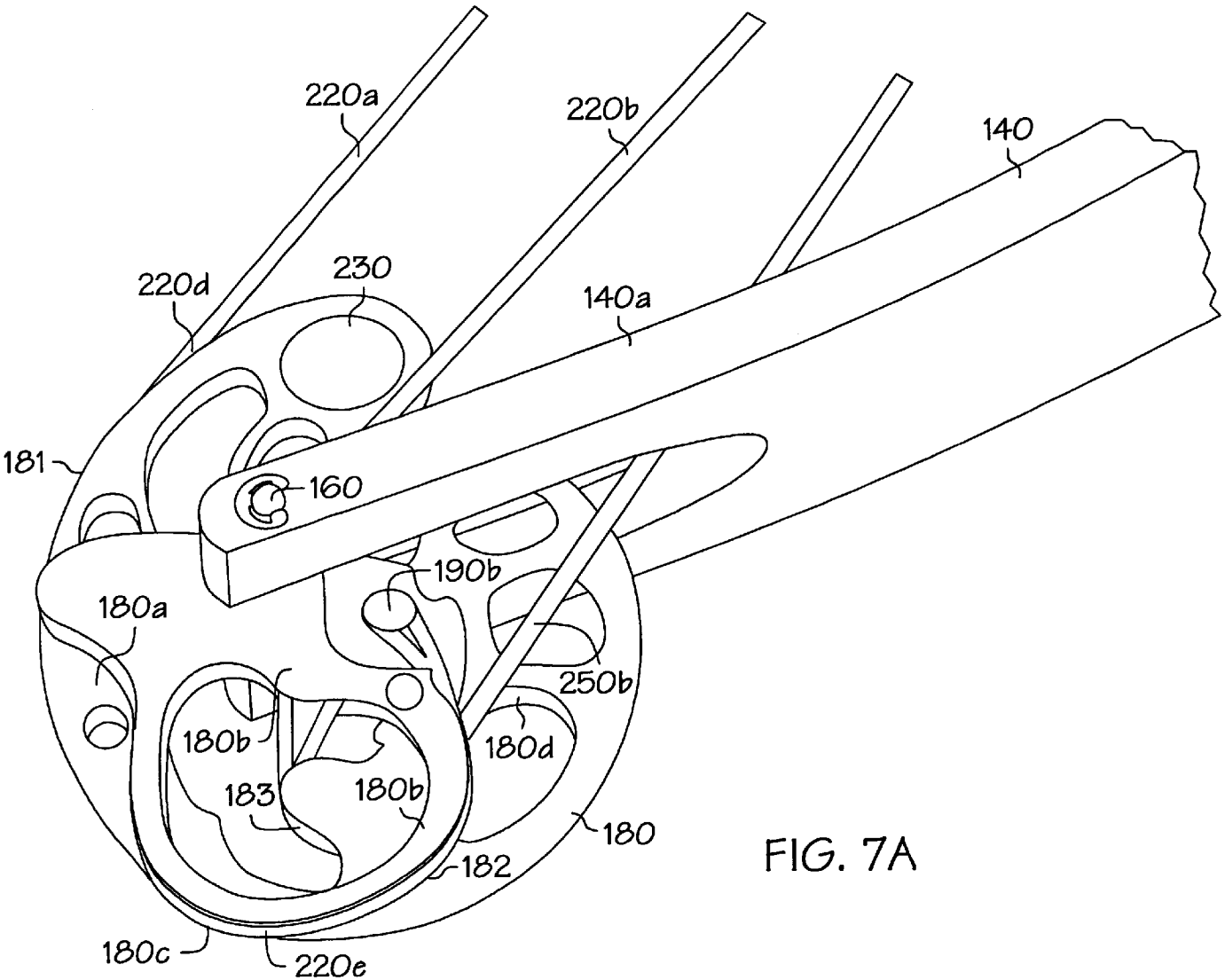
FIG. 7*a* is an enlarged view of the first side of a cam assembly, as shown in an undrawn state.
Figure 7B:
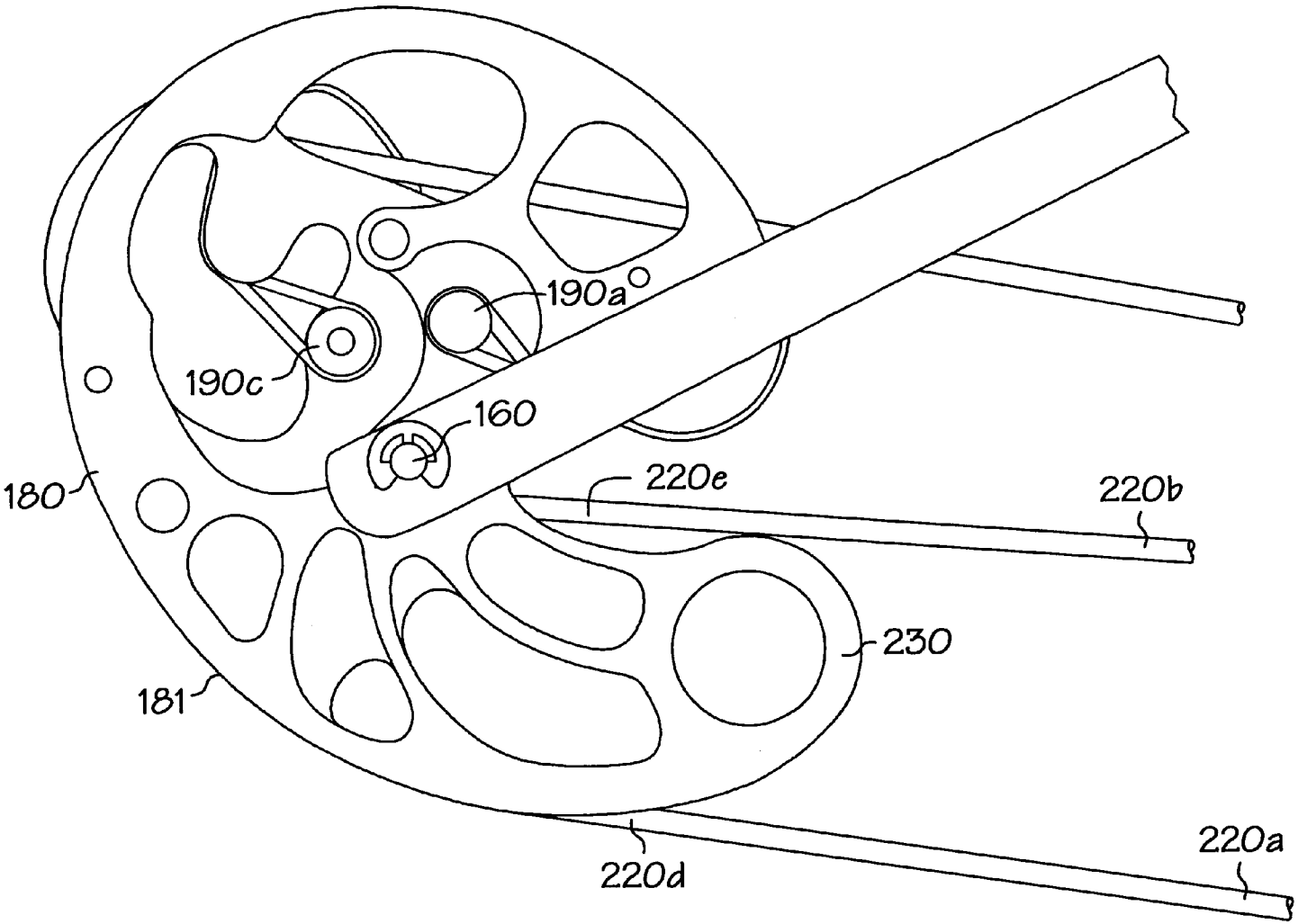
FIG. 7*b* is an enlarged view of the second side of a cam assembly, as shown in an undrawn state.

As shown in FIGS. 6, 7*a* and 7*b*, the outer ends of the first and second bow limbs provide wheel receiving slots which define wheel mounting forks, respectively designated by the numbers 120*a* and 140*a*, for mounting axle pins 150 and 160. An idler or pulley 170 is concentrically mounted on axle pin 150 for rotation about axle pin 150. In this form of the invention, pulley 170 is provided with a single track 172. As shown in FIGS. 7*a* and 7*b*, one form of eccentric cam 180 is mounted on an axle pin 160 for rotation about axle pin 160. In the form shown in FIGS. 7*a* and 7*b*, cam 180 has three eccentrically oriented tracks, 181, 182, and 183 formed in the outer periphery thereof to provide three separate cable tracks.

Bow 100 further includes a first cable 220 which is trained around pulley 170 to form bow-string 220*a* and return section 220*b*. First section 220*c* of first cable 220 is received in track 172. The end portions 220*d* and 220*e* of first cable 220 are received in primary string pay-out track tracks 181 and secondary string pay-out track 182, respectively on cam assembly 180, as shown in FIGS. 7*a* and 7*b*. The pay-out track allows for pay-out of additional cable to section 220*a* as section 220*a* of cable 220 is drawn out. The secondary string pay-out track allows for pay-out of additional cable to section 220*b* as section 220*a* of cable 220 is drawn out. The ends of the section 220*d* and 220*e* of section 220*a* and 220*b* are anchored to cam assembly 180 by cable anchor pins 190*a* and 190*b* fixed to cam 180.

First cable 220 functions as a bow string and includes a nock point 280 between the first and second ends. Nock points 280 may optionally be formed of a thread material wound around the bow string and tied. Nock points 280 are positioned such that an arrow having its shaft supported by arrow rest 145 and its nock engaged by the first cable will be perpendicular to the undrawn cable in the undrawn condition. The nock points which are located on either side of the nock position of the arrow on the bowstring serve to indicate the proper position of the bowstring in relation to the trigger latch when the crossbow is cocked. In some cases, these nock point indicators can be painted on the bow string.

As best shown in FIG. 6, an anchor cable 250 is anchored at one forked end 250*a* to axle pin 150 and at the other end passes around cam groove 183 on the take-up side of cam 180. Take-up track 183 takes up excess anchor cable 250 as the bow is drawn and the first and second limbs 120 and 140 draw nearer to one another. The other end 250*b* of cable 250, as shown in FIG. 7*b*, is attached to anchor pin 190*c* and positively ties the two bow limbs 120 and 140 together to form a direct connection between the limbs 120 and 140.

As shown in FIG. 5, as bow-string 220*a* is drawn, a length of first cable 220 is unwound from pulley track 172 about pulley 170 and pulley 170 rotates about its axis. Moreover, cam 180 rotates about its axis and additional bow-string 220*a* is unwound from primary string payout track 181. As bow-string 220*a* is unwound, additional length of return section 220*b* is unwound from secondary string payout track 182. Simultaneously, bow limbs 120 and 140 are drawn toward one another and a portion of anchor cable 250 is wound around take-up track 183 storing energy in limbs 120 and 140.

As shown in greater detail in FIGS. 7*a* and 7*b*, cam 180 has a first cam portion 180*a*, a second cam portion 180*b* adjacent to first cam portion 180*a* and a third cam portion 180*c* adjacent to second cam portion 180*b* and apart from first cam portion 180*a*. First cam portion 180*a* has a primary string payout track 181 along its periphery to accommodate a cable thereon. Second cam portion 180*b* has a take-up track 183 along its periphery to accommodate a second cable therein and third cam portion 180*c* has a secondary string payout track 182 along its periphery to accommodate a third cable thereon.

Cam 180 further comprises a first anchor means 190*a* to which a said first cable may be anchored, a second anchor means 190*c* to which a said second cable may be anchored and a third anchor means 190*b* to which a said third cable may be anchored.

Desirably, as further shown in FIGS. 7*a* and 7*b*, take-up track is substantially elliptical. More desirably, the elliptical take-up track has a minor axis and a major axis and the length of the minor axis is about one-half the length of the major axis.

Cam assembly 180 is characterized in that the ratio of the length of the take-up track 183, to the length of the primary string pay-out track is less than about 0.4.

Cam assembly 180 is further characterized in that the ratio of the length of the take-up track, cam groove 183 and the length of the primary and secondary track pay-outs 181 and 182 is less than about 0.3.

In place of the cam assembly shown in FIGS. 7*a* and 7*b*, the invention also contemplates the use of cam assemblies having different designs. Desirably, a cam assembly having a ratio of the length of the take-up track to the length of the primary string pay-out track of less than about 0.4 will be used. A cam assembly characterized as having a ratio of the length of the take-up track and the length of the total primary and secondary track pay-out tracks of less than about 0.3 may also be used.

Figure 8A:
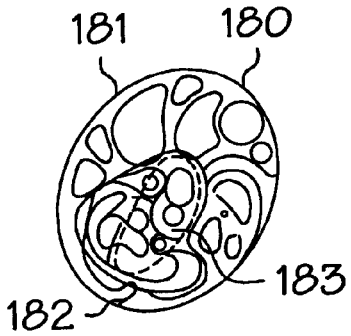
FIGS. 8*a*–8*c* show alternative embodiments of the cams which may be used in the inventive crossbows.
Figure 8B:
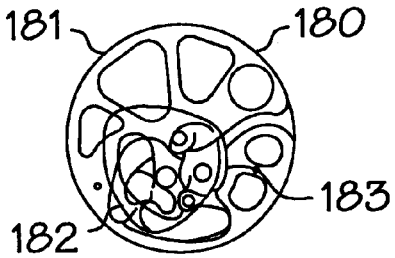
Figure 8C:
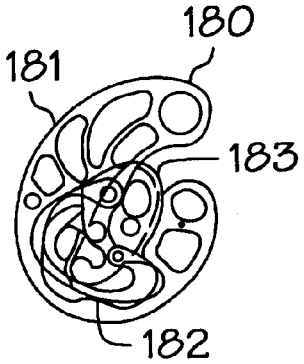

FIGS. 8*a*–8*c* illustrate three inventive cam assemblies suitable for use in the instant invention. Each of cam assemblies 180 has three eccentrically oriented tracks, 181, 182, and 183 which define a take-up track, a primary and a secondary track which are of lengths chosen to meet the above requirements.

The cam assemblies 180 of FIGS. 8*a* and 8*c* include a primary string payout track 181 along a substantially egg-shaped portion of the cam, a secondary string payout track 182 and a take-up track 183 for receiving a portion of an anchor cable thereon.

Cam assembly 180 shown in FIG. 8*b* includes a primary string payout track 181 along a substantially circular portion of the cam, a secondary string payout track 182 and a take-up track 183 for receiving a portion of an anchor cable thereon.

The cams of FIGS. 8*a*–8*c* are similar in that they are all characterized in that the ratio of the length of the take-up track to the length of the working portion of the main string pay-out track on the level nocking point cams is less than about 0.4. This ratio is less than that of a number of other cams commercially available. Moreover, the ratio of the length of the actual working portion of the take-up track and the length of the total working portions of the primary and secondary track pay-outs on the level nocking point cams is less than about 0.3. This ratio is less than the ratio measured on several other commercially available cams.

It is noted that in certain embodiments, the primary string pay out track may extend slightly beyond where the bow string enters to allow for overshoot of the bow string.

Although cam assembly 180 is shown in the figures to have a plurality of openings therethrough, the cam assembly may have additional or fewer openings therethrough or may be of solid construction. The cam assembly may alternatively have recessed portions to achieved a reduced weight.

As further seen in FIG. 7*a* and 7*b*, cam assembly 180 has an optional weighted disk 230. Details of the weighted disk may be found in U.S. Pat. No. 5,809,982 and U.S. Pat. No. 5,996,567.

More generally, cam assembly 180 may comprise a counteracting weight. The counteracting weight may preferably be constructed from a fairly flexible material such as rubber, plastic or other flexible material. Other suitable materials include aluminum, hardened rubber or tungsten carbide. The counterweight may define or include an enclosed hollow which may contain a counteracting weight material such as a fluid or other flowable material such as oil, water or liquid mercury and may alternatively or additionally include a plurality of particulate matter such as sand or beads composed of steel, lead, tungsten, brass, plastic, rubber or other material including but not limited to metal alloys. In alternative embodiments the hollow may partially contain any variety or combination of counter acting weight material.

A counter weight may also be provided in idler or pulley 170.

Pulley 170 is shown in the figures as having a plurality of openings 178 therethrough which reduce the weight of the pulley assembly. The openings may be differently shaped and/or arranged. The pulley may optionally have additional or fewer openings therethrough or may be of solid construction. A reduced weight pulley having recessed portions rather than openings extending therethrough may also be used.

The invention further contemplates the use of idler wheels or pulleys having more than one track in place of pulley 170 shown in FIGS. 4–6. Where a two track idler is used, the bow string which comes from the main string pay-out track of the cam wraps partially around one track of the idler and is then affixed to the idler. The bowstring which is paid out from the secondary string payout track is wrapped around the opposite side and track of the two track idler and is then affixed to the idler.

Figure 9A:
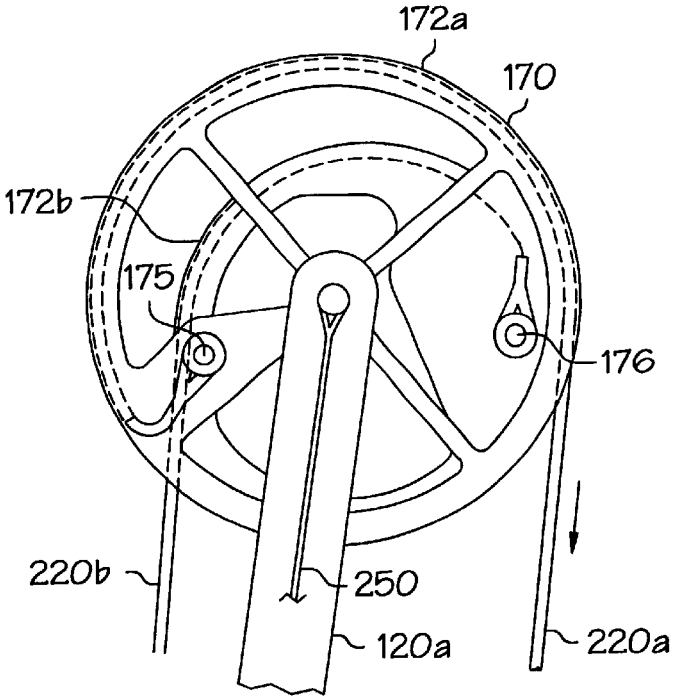
FIGS. 9*a* and 9*b* show fragmentary elevational views of pulleys that may be used in conjunction with the inventive bows.

An example of a two track idler or pulley is shown at 170 in FIG. 9*a*. Pulley 170 includes first pulley track 172*a* and second pulley track 172*b*. An end portion of first cable 220*a* is trained about semi-circular first track 172*a* of pulley 170 to form a bow-string section. First cable 220*a* is anchored to pulley 170 with cable anchor pin 175. Optionally, first cable 220*a* may be anchored in the first pulley track. The other end of first cable 220*a* is received in the primary string payout track of the cam assembly of the bow. An end portion of second cable 220*b* is trained about semi-circular second pulley track 172*b* to form a return section. Second cable 220*b* is anchored to pulley 170 with cable anchor pin 176. Optionally, second cable 220*b* may be anchored in the second pulley track. The other end of second cable 220*b* is trained about the secondary string payout track of the cam assembly. The first and second pulley tracks may also be substantially circular.

Figure 9B:
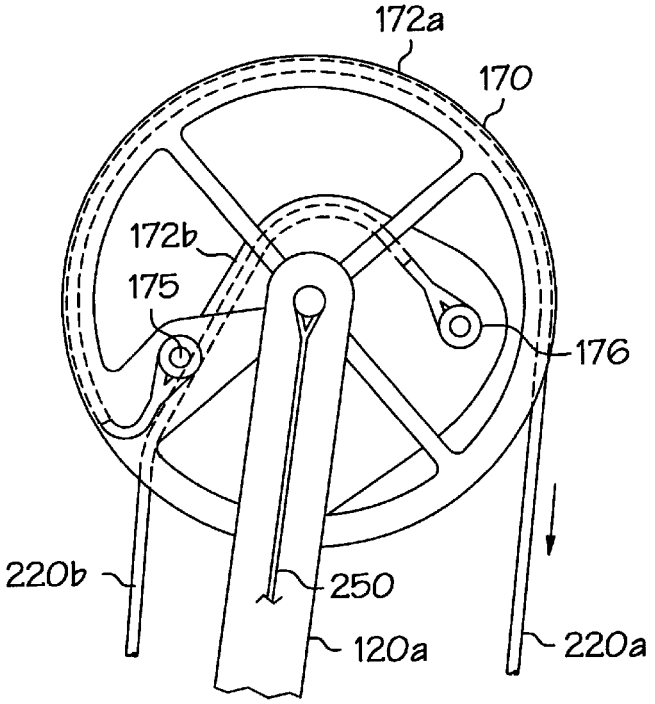

The first and second pulley tracks may also be non-circular and designed to work in conjunction with the inventive cam to ensure that the arrow moves in a straight line path as the arrow exits the crossbow. An example of a pulley having a non-circular second pulley track is shown at 170 in FIG. 9*b*. The pulley of FIG. 9*b* is similar to that of FIG. 9*a* differing in that second pulley track 172*b* is curved, but not circular. Those of ordinary skill in the art will recognize that curved tracks other than those shown may be used as well.

Figure 10A:
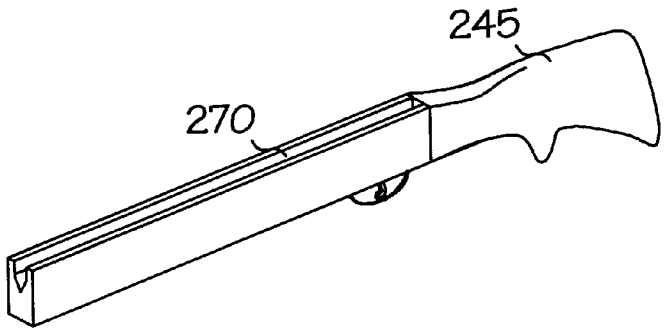
FIG. 10*a* shows a crossbow stock with a track.
Figure 10B:
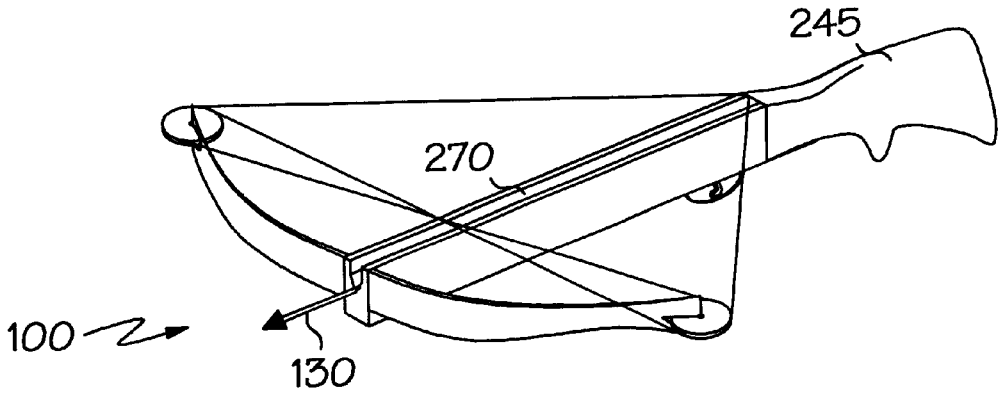
FIG. 10*b* shows the crossbow of FIG. 10*a* in the drawn position with an arrow in the track.

The inventive crossbows depicted above are shown in a trackless embodiment. A trackless crossbow supports the projectile only at the tip and at the nock. As shown generally at 100 in FIG. 10*a*, the inventive crossbows may also be provided with a stock 245 having a track 270 in which the projectile may lay. As shown in FIG. 10*b*, track 270 supports the full length of the projectile 130 prior to launching the projectile and continues to support that portion of the projectile still in contact with the track as the projectile leaves the crossbow. Examples of a crossbow with a track may be found in U.S. Pat. No. 4,649,891 and U.S. Pat. No. 5,025,771.

Additional details concerning crossbow construction in general and suitable stocks and trigger mechanisms in particular, may be found, inter alia in U.S. Pat. No. 4,693,228, U.S. Pat. No. 4,827,894, U.S. Pat. No. 5,025,771, U.S. Pat. No. 5,649,520, U.S. Pat. No. 5,884,614.

It is also noted that the inventive bows exhibit a lesser amount of limb travel and will have less mass in motion during shooting resulting in less shock and vibration being felt by the archer. The reduced limb tip deflection resulting from the use of the inventive cams may necessitate the use of stiffer limbs.

Other features which may be combined with the inventive bow are described in the following commonly assigned, cofiled US applications:

U.S. application Ser. No. 09/503,013; U.S. application Ser. No. 09/502,354; U.S. application Ser. No. 09/502,149; U.S. application Ser. No. 09/502,643 and U.S. application Ser. No. 09/502,917.

In addition to the specific embodiments claimed below, the invention is also directed to other embodiments having any other possible combination of the dependent features claimed below.

It will be understood that this disclosure, in many respects, is only illustrative. Changes may be made in details, particularly in matters of shape, size, material, means of attachment, and arrangement of parts without exceeding the scope of the invention. Accordingly, the scope of the invention is as defined in the language of the appended Claims.

What is claimed is:

1. A crossbow comprising:

a mounting portion;

a first limb supported by the mounting portion;

a second limb supported by the mounting portion;

a pulley rotatably mounted upon the first limb for rotation about a first axle, the pulley including a pulley track;

a cam assembly rotatably mounted upon the second limb for rotation about a second axle, the cam assembly having a primary string payout track, a secondary string payout track, and a take-up track; and wherein the ratio of the length of the take-up track to the length of the primary string payout track is less than about 0.4.

2. The crossbow of claim 1 further comprising:

a first cable having a first end portion terminating in a first end anchored to the cam assembly and a second end portion terminating in a second end anchored to the cam assembly, the first end portion received in the primary string payout track, the second end portion received in the secondary string payout track, a portion of the first cable trained about the pulley and received in the pulley track to form a bow-string section and a return section, and an anchor cable extending between the first limb and the cam assembly and received in the take-up track.

3. The crossbow of claim 2 wherein the ratio of the length of the take-up track and sum of the lengths of the primary string payout track and the secondary string payout track is less than about 0.3.

4. The crossbow of claim 2 wherein the first and second limbs are flexible.

5. The crossbow of claim 2 wherein the first limb forms a fork with a first prong and a second prong and a gap therebetween, the pulley residing in the gap, and wherein the anchor cable bifurcates adjacent to the fork in the first limb, the bifurcated portion mounted to the first axle in the first limb fork.

6. The crossbow of claim 1 wherein the take-up track is substantially elliptical.

7. The crossbow of claim 6 wherein the elliptical take-up track has a minor axis and a major axis, the length of the minor axis being about one-half the length of the major axis.

8. The crossbow of claim 1 having a stock with a track for receiving a projectile.

9. The crossbow of claim 1 having a trackless stock.

10. The crossbow of claim 1 wherein the first and second limbs are made as a single unit.

11. The crossbow of claim 10 wherein the first and second limbs are supported centrally by the mounting portion.

12. The crossbow of claim 1 wherein the cam assembly further comprises a counteracting weight.

13. The crossbow of claim 1 wherein the pulley further comprises a counteracting weight.

14. In a crossbow having an upper limb and a lower limb, the upper limb having a rotatably mounted pulley with a track and the lower limb having a dual feed-out cam with a primary string payout track and a take-up track, the improvement comprising the ratio of the length of the take-up track to the length of the primary string payout track being less than about 0.4.

15. The crossbow of claim 14 having a track for receiving a projectile therein.

16. The crossbow of claim 14 having a trackless stock.

17. The crossbow of claim 14 wherein the cam further comprises a counteracting weight.

18. The crossbow of claim 14 wherein the pulley further comprises a counteracting weight.

* * * * *